United States Patent [19]

Goldfarb

[11] 4,363,482

[45] Dec. 14, 1982

[54] SOUND-RESPONSIVE ELECTRONIC GAME

[76] Inventor: Adolph E. Goldfarb, 4614 Monarca Dr., Tarzana, Calif. 91356

[21] Appl. No.: 233,461

[22] Filed: Feb. 11, 1981

[51] Int. Cl.[3] ..... A63F 9/00

[52] U.S. Cl. ..... 273/1 GC; 273/85 G

[58] Field of Search ..... 273/1 GC, 1 GE, 1 E; 434/157, 185

[56] References Cited

U.S. PATENT DOCUMENTS

| | | | |
|---|---|---|---|
| 3,589,719 | 6/1971 | Glass et al. | 273/1 GC |
| 3,865,367 | 2/1975 | Breslow et al. | 273/1 GC |
| 4,281,833 | 8/1981 | Sandler et al. | 273/856 |
| 4,305,131 | 12/1981 | Best | 273/1 E |

FOREIGN PATENT DOCUMENTS

| | | | |
|---|---|---|---|
| 54-13309 | 1/1979 | Japan | 434/185 |

*Primary Examiner*—Vance Y. Hum
*Assistant Examiner*—Leo P. Picard
*Attorney, Agent, or Firm*—Romney, Golant, Martin, Disner & Ashen

[57] ABSTRACT

An electronic game apparatus facilitates the playing of a parlor game. The game apparatus generates a series of player-interrogation signals, and defines a corresponding "correct" sequence of auditory and switch-closure responses by the players (or player). The correct sequence is defined in accordance with established game rules that are known to the player(s). The game apparatus receives actual auditory and switch-closure responses from the player(s), compares the responses with the correct sequence, and indicates visually and auditorily whether each response is correct.

9 Claims, 12 Drawing Figures

Fig. 1.
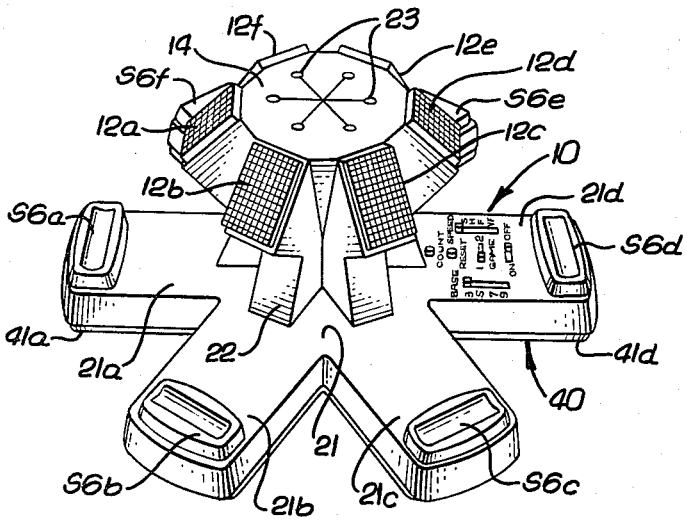
Fig. 1a.
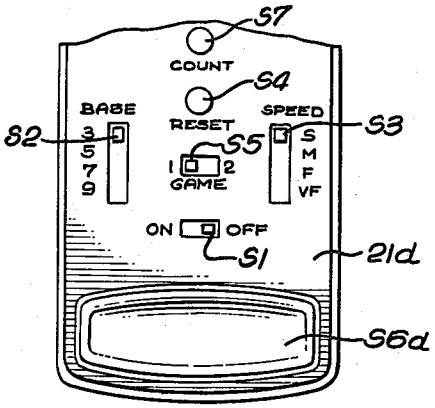
Fig. 2.
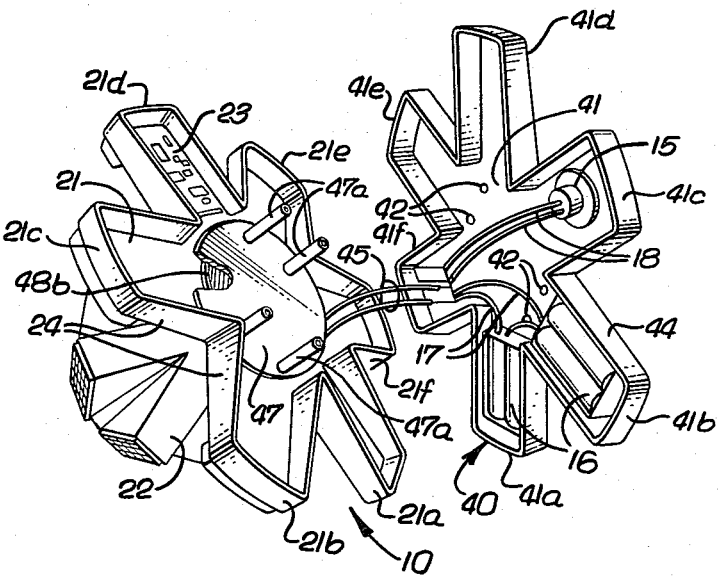
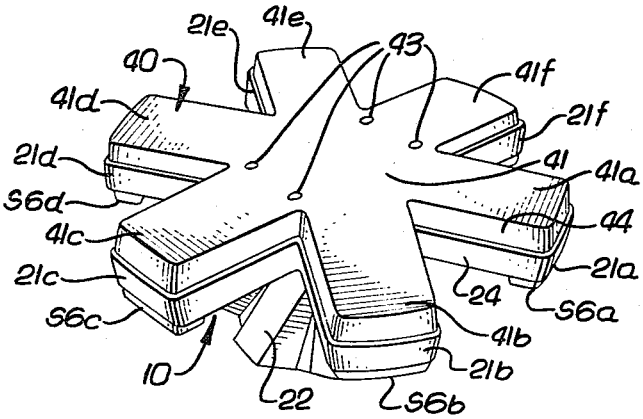
Fig. 3.

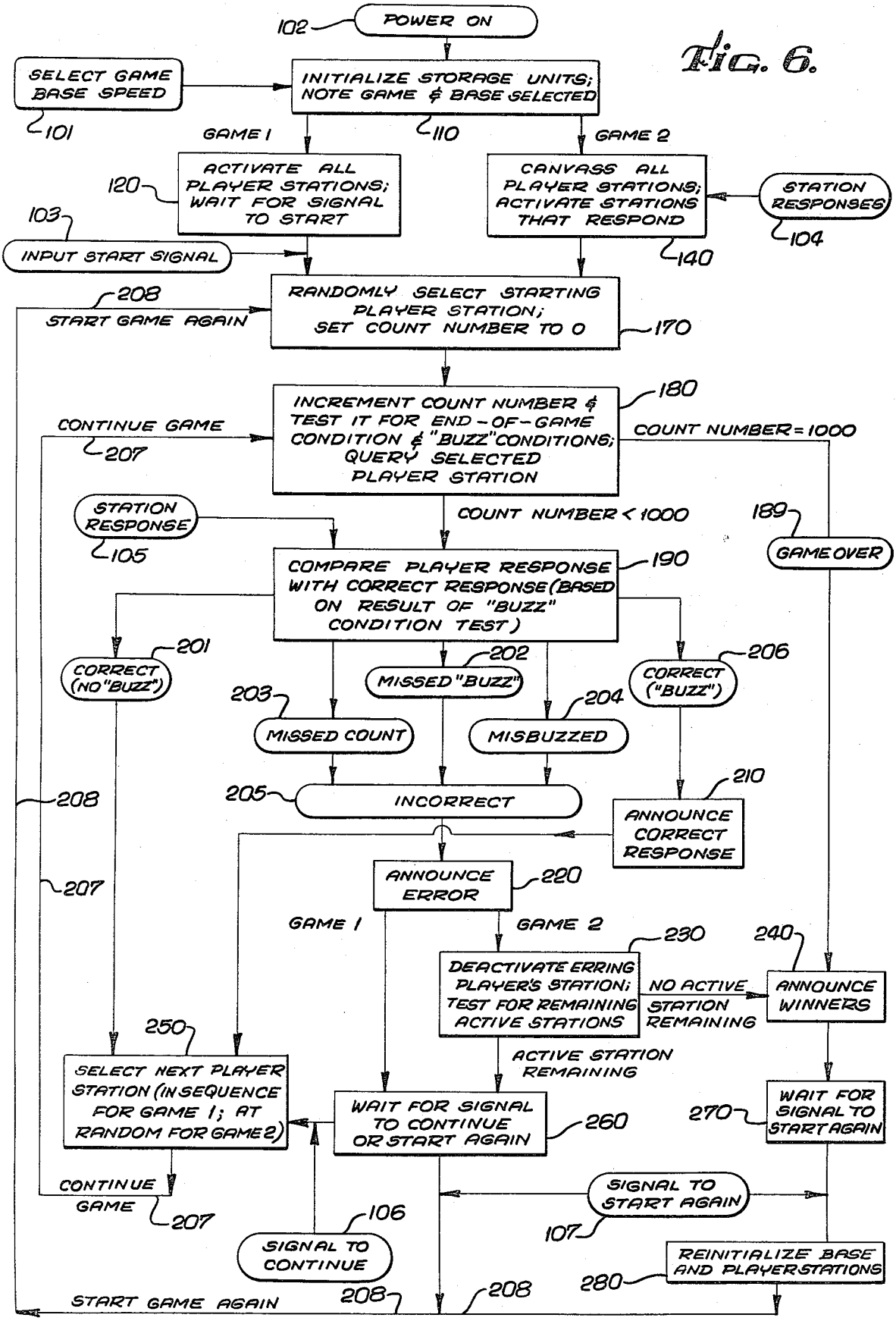
Fig. 6.
POWER ON
102
SELECT GAME BASE SPEED
101
INITIALIZE STORAGE UNITS; NOTE GAME & BASE SELECTED
110
GAME 1
GAME 2
ACTIVATE ALL PLAYER STATIONS; WAIT FOR SIGNAL TO START
120
CANVASS ALL PLAYER STATIONS; ACTIVATE STATIONS THAT RESPOND
140
STATION RESPONSES
104
103
INPUT START SIGNAL
208
START GAME AGAIN
RANDOMLY SELECT STARTING PLAYER STATION; SET COUNT NUMBER TO 0
170
INCREMENT COUNT NUMBER & TEST IT FOR END-OF-GAME CONDITION & "BUZZ" CONDITIONS; QUERY SELECTED PLAYER STATION
180
CONTINUE GAME
207
COUNT NUMBER=1000
COUNT NUMBER < 1000
189
GAME OVER
STATION RESPONSE
105
COMPARE PLAYER RESPONSE WITH CORRECT RESPONSE (BASED ON RESULT OF "BUZZ" CONDITION TEST)
190
CORRECT (NO "BUZZ")
201
MISSED "BUZZ"
202
CORRECT ("BUZZ")
206
MISSED COUNT
203
MISBUZZED
204
INCORRECT
205
ANNOUNCE CORRECT RESPONSE
210
ANNOUNCE ERROR
220
GAME 1
GAME 2
DEACTIVATE ERRING PLAYER'S STATION; TEST FOR REMAINING ACTIVE STATIONS
230
NO ACTIVE STATION REMAINING
ANNOUNCE WINNERS
240
ACTIVE STATION REMAINING
SELECT NEXT PLAYER STATION (IN SEQUENCE FOR GAME 1; AT RANDOM FOR GAME 2)
250
WAIT FOR SIGNAL TO CONTINUE OR START AGAIN
260
WAIT FOR SIGNAL TO START AGAIN
270
CONTINUE GAME
SIGNAL TO START AGAIN
107
SIGNAL TO CONTINUE
106
REINITIALIZE BASE AND PLAYER STATIONS
280
START GAME AGAIN

Fig. 7.

| PLAYER STATION RESPONSE | COUNT NUMBER: SATISFIES "BUZZ" CONDITIONS ("BUZZ" FLAG SET) | COUNT NUMBER: DOES NOT SATISFY "BUZZ" CONDITIONS ("BUZZ" FLAG NOT SET) |
|---|---|---|
| PRESSES "BUZZ" SWITCH | CORRECT ("BUZZ") | INCORRECT: MISBUZZED |
| EXCITES MICROPHONE (MICROPHONE FLAG SET) | INCORRECT: MISSED "BUZZ" | CORRECT (NO "BUZZ") |
| NONE (MICROPHONE FLAG NOT SET) | INCORRECT: MISSED COUNT | |

Fig. 9.

| PLAYER STATION "i" | MEMORIES: PLAYER PRESENT | MEMORIES: PLAYER ACTIVE |
|---|---|---|
| 1 | | |
| 2 | | |
| 3 | | |
| 4 | | |
| 5 | | |
| 6 | | |

| FLAG | CONDITION |
|---|---|
| "BUZZ" | |
| MICROPHONE | |

| REGISTER OR MEMORY | STORED VALUE |
|---|---|
| COUNT NUMBER | |
| BASE SELECTED | |
| RANDOM COUNT | |
| ADDRESS STATION "i" | |
| FLASH INDEX "j" | |

SOUND-RESPONSIVE ELECTRONIC GAME

BACKGROUND OF THE INVENTION

1. Field

This invention is in the field of electronic games, and particularly relates to portable devices that present the player(s) with stimuli requiring suitable response within a limited time.

2. Prior Art

Previous toys of the type described above have generally required the user(s) or player(s) to respond by manipulating one or more switch handles or buttons. In the now-familiar electronic football or baseball games, for example, the switches often control the apparent position, attitude, or simulated thrust of a moving spot or shape that represents the player. The spot may be an illuminated lamp or grouping of lamps, or in the slightly related field of video-computer games the spot may be an elaborately shaped figure formed by the video screen technology. Another remote relative is the programmed learning device or question-and-answer game in which the student or player manipulates levers, buttons, or a keyboard to answer questions.

In all these examples the correctness of the human user's response is expressed entirely in terms of her or his manipulation of the *mechanical* input devices (switches, levers, buttons, or keys). In addition these examples depend on *visual* "problem-situation" stimuli; both the stimuli and the game rules deal with geometrical interactions of images.

In the hitherto unrelated area of mechanical toy design, some toys have been made responsive to sound. For example, some toy cars are made maneuverable by operation of a hand-held "clicker"—a device that emits a clicking or other distinctive sound to which the cars respond. These toys are generally responsive to the control sound whenever the toys are operating; that is, there is no query-and-limited-time-response pattern. Of course the criteria for "correctness" of the "clicker" operation are completely geometrical of mechanical—e.g., whether the toy executes desired maneuvers, or strikes particular objects.

No prior-art electronic games are known in which a user must respond acoustically (in particular, orally) to a game stimulus. Likewise no prior-art electronic games are known in which the correctness of each response is determined almost entirely on the basis of previous responses.

Some objects of the present invention are to provide an electronic game apparatus in which (1) a user must respond *both* orally and mechanically to game stimuli, and/or (2) the correct response at each player's turn is determined by the previous responses and by a fixed, predetermined set of rules that is known by all the players, and/or (3) visual-display stimuli do not form part of the criteria for correctness, except to the extent of designating which player is to respond.

A certain traditional parlor game involves a plurality of players counting aloud, each player in turn saying one number in the normal numerical sequence (i.e., "one, two, three, . . . ")—but with *certain numbers replaced* by a distinctive word or other prearranged sound. For example, such a sound replaces all numbers that either (1) have a certain numeral as one digit or (2) are multiples of that numeral. The numeral chosen for use in the game may be called the "base numeral." If the base numeral is nine, for instance, the distinctive word or sound replaces the numbers 9, 18, 19, 27, 29, 36, 39, and so on; if the prearranged word is "alligator," the correct sequence would include this segment: " . . . sixteen, seventeen, alligator, alligator, twenty, twenty-one, . . . ." A player errs when his turn arrives if he *should* say "seventeen" but instead says "alligator"; or if he should say "alligator" but says "eighteen" or "nineteen"; or if he becomes confused and is unable to make any response in the rhythm of the counting. Depending on the form of the game, either (1) a player who errs in any of these three ways may be expelled from the game, so that the number of active players decreases until only a winner remains (or some arbitrary count is reached at which all remaining players are winners); or (2) the sequence is continued with all the players remaining active, any errors giving rise only to amusement.

In this traditional game the group of players keeps track mentally of the numbers already spoken, keeps in mind the base numeral and the operation of the game rule, and verbally takes note of any player's error. It is accordingly almost meaningless to conceive of such a game being played by only one person. In fact, a relatively large group is usually used to provide an accurate referee of the correctness of each response, since there can be disagreements as to how far the sequence has progressed—particularly, for instance, when the game reaches a series of numbers such as that from 89 through 99, with base numeral nine. No prior-art device is known in which the playing of such a game is augmented by electronic apparatus to keep the count "straight," announce errors and recognize correct responses, and facilitate enjoyable play by a small number of players and even one player. One reason for absence of such apparatus may well be the greater difficulty, if not practical impossibility, of providing the necessary word-discriminating capability at low cost.

Thus further objects of the present invention are to provide a low-cost electronic apparatus that enhances the playing of a game analogous to the traditional parlor game described above, by indicating which player has the turn, keeping track of the count and rules, and indicating correct and incorrect play.

SUMMARY OF THE DISCLOSURE

The above-described objects have been achieved by providing an electronic game apparatus with two distinct inputs, one preferably an acoustic sensor (i.e., microphone) and the other an electrical switch, though in one variation of the invention both may be switches. By speaking into a microphone for all responses which are simply numbers, but pressing a switch as the replacement for numbers that include or are multiples of the base numeral, the players supply the necessary discrimination that permits a reasonably economical electronic unit to evaluate player responses. The switch, in addition to registering a response with the electronic unit for evaluation, also actuates an audible tone, preserving the auditory character of the game for the players. For example, if the tone is a buzzing sound, the correct number sequence illustrated earlier with the word "alligator" would sound thus: " . . . sixteen, seventeen, (buzz), (buzz), twenty, twenty-one, . . . ."

Circuitry responsive to the microphone generates a definite electrical signal when *any* adequately loud sound is received—always the same signal, regardless of the intelligence content of the sound. Thus the counting aloud serves only to inform the electronic unit that the count is advancec (but not by a "buzz" number)—and the unit itself keeps track of what number each count should represent, without discriminating between the sounds.

The apparatus advantageously defines a plurality of player stations, each of which has an associated lamp or other visual device for indicating when the turn passes to that particular station—i.e., for prompting or interrogating the player at that station. The device may also emit a sound at the same time as it produces the visual interrogation signal, and advantageously emits audio indiations of accuracy and error of the player responses; however, in the interest of economy it is preferable to use only a single loudspeaker and a single microphone to service all the player stations in common.

Additional economy can be achieved within the scope of the invention by using a second switch (perhaps producing a different tone from the first) in place of the microphone, but in this version for most players it would still be desirable for the players to count aloud, and thus the elegance of the microphone version would be lost. On the other hand, more sophisticated players might find it more challenging to play the game entirely with tones, keeping the count only in their heads, and for such players the two-switch/two-tone version could be particularly appealing. In this version of the game the correct audible sequence illustrated earlier might sound thus: " . . . (ring), (ring), (buzz), (buzz), (ring), (ring), . . . ." An even more sophisticated version of the game can be played using the microphone but speaking aloud *any* words, even including *incorrect* numbers (without penalty)—with the players keeping the correct count only in their heads. In this version the correct audible sequence illustrated earlier might sound thus: "horseradish, ninety-three, (buzz), (buzz), Mantovani, beerbottle, . . . ."

Advantageously the device is provided with the replacement-tone switch and with *both* the microphone and a switch that can be pressed to obtain the same result as speaking into the microphone. This dual provision permits playing any of the game versions mentioned above, and also facilitates troubleshooting should the microphone input function fail.

In addition the device is advantageously provided with a power switch, a switch for selecting the numeral to be used as the base numeral, a switch for selecting game rules (e.g., whether all player stations are interrogated, whether players are addressed in sequence or at random, and whether they are eliminated or retained after an error), a switch for selecting how quickly a player must respond, and a switch for indication by the player(s) that the game is to start over from a count of "one."

An indispensable part of any practical embodiment of the invention is of course a programmable microprocessor unit, to (1) receive the various switch settings and player responses, (2) operate the visual and auditory output signals to interrogate the players and announce their success or failure, (3) perform the necessary arithmetic to "keep the count" and to apply the game rules to determine what each correct response should be, and (4) compare each actual response with the corresponding correct response to determine whether the player succeeded or failed. It may be emphasized, however, that the purely arithmetic functions considered alone as such—i.e., the essentially computational manipulations in the third microprocessor function mentioned in this paragraph—are regarded as within the public domain and are not independently the subject matter of the instant invention as defined by the appended claims.

As a matter of inventor preference the apparatus also advantageously comprises a housing that defines a plurality of visually distinct player stations, each with an associated visual player-interrogation light or other display means, and each advantageously having configuration that visually suggests independent control of the number-replacement-tone switch and an independent microphone. Both these configuration features enhance the excitement of the game, particularly for children, by creating the atmosphere or sensation of individualized two-way communication between each player and the apparatus; yet the game apparatus operates in a perfectly satisfactory manner to achieve the objects of the invention with only a unitary microphone and a unitary switch used by all players in common.

The foregoing principles and features of the invention may be more readily understood and visualized from the detailed description which follows, together with reference to the accompanying figures, of which:

BRIEF DESCRIPTION OF THE DRAWINGS

FIG. 1 is a perspective drawing of a game apparatus that is a preferred embodiment of the invention, shown right-side-up and with a side and the top of the apparatus visible.

FIG. 1*a* is a closeup plan or orthographic view of a portion of the same apparatus, looking straight down, showing details of the game controls.

FIG. 2 is another perspective view of the same apparatus taken with the apparatus on its side and partially disassembled, and generally showing the bottom parts of the apparatus.

FIG. 3 is yet another perspective view of the same apparatus, shown upside-down and showing the underside of the apparatus.

FIG. 6 is a simplified flow chart of a procedure that is automatically followed by the circuit of FIGS. 4 and 5 during the playing of a game using the invention.

FIG. 7 is a diagram showing the possible relationships between "correct" and actual player responses during the playing of a game using the invention.

FIG. 9 is a diagram of certain information-storage provisions of the circuit shown in FIGS. 4 and 5.

DETAILED DESCRIPTION OF PREFERRED EMBODIMENTS

Figure 4:
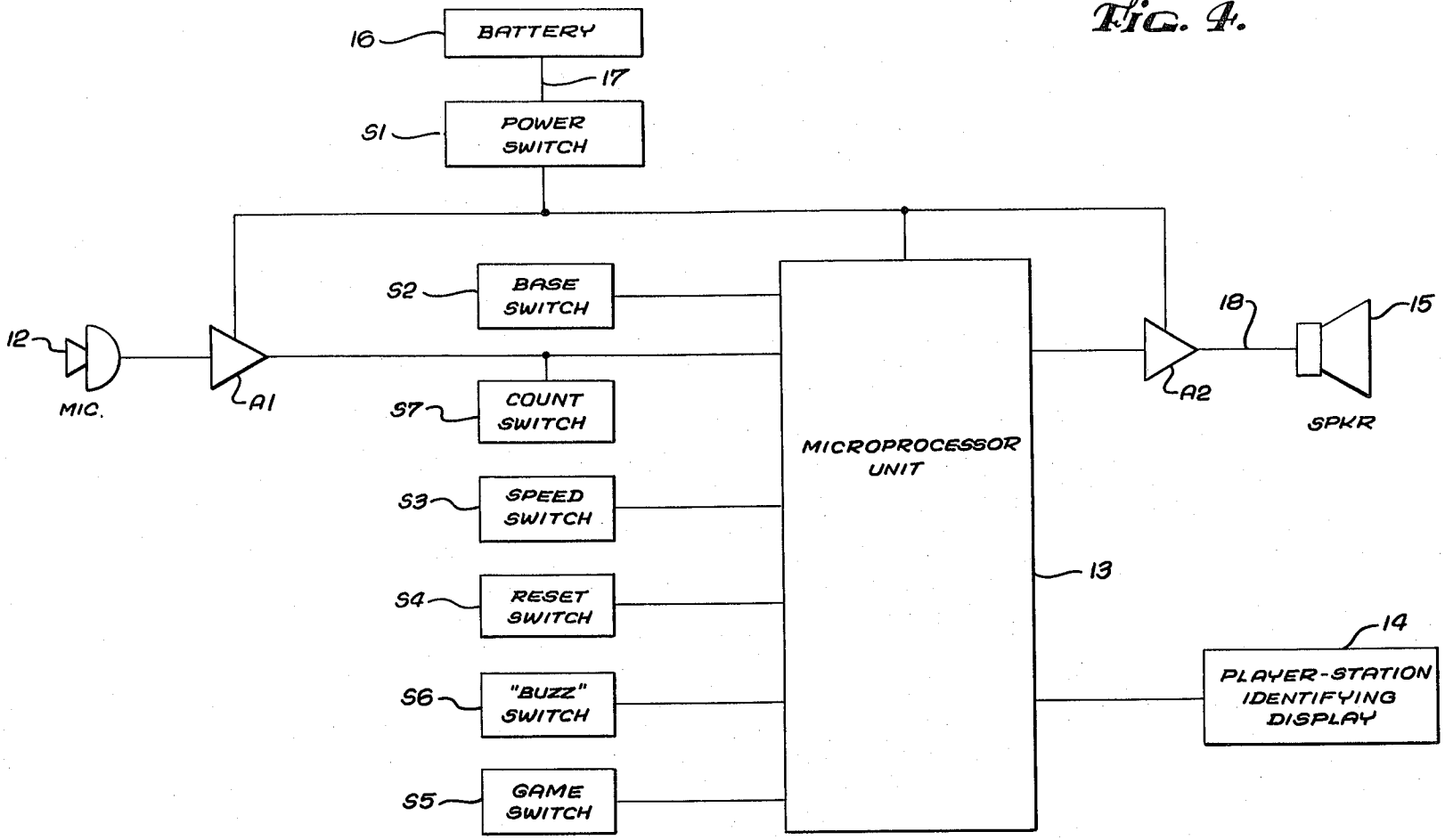
FIG. 4 is an electronic block diagram of a circuit that is used within the preferred embodiment illustrated in FIGS. 1 through 3.

I. The Game As Played—From The Players' Perspective

As shown in FIGS. 1 through 3, a preferred embodiment of the invention is built in the form of a housing 10 that is tiltably secured to a base 40. The housing 10 consists of a generally horizontal lower section 21 and an upraised central section 22. Both the horizontal section 21 and upraised section 22 are styled to define a plurality of player stations: thus the horizontal section 21 is segmented into individually extending radial portions 21*a*, 21*b*, 21*c*, 21*d*, 21*e* and 21*f*. Each of these radial portions respectively terminates in a configuration that serves as a separate switch handle S6*a*, S6*b*, S6*c*, S6*d*, S6*e* and S6*f* at each player station.

In a parallel fashion the upraised central section or pillar 22 is configured in a plurality of microphone or speaker grills 12*a*, 12*b*, 12*c*, 12*d*, 12and 12*f*, which are respectively aligned with the corresponding radial portions 21*a* to 21*f* of the lower section 21 and which suggests individualized two-way audio communication between each player station and the apparatus.

The top of the pillar 22 terminates in a translucent or dark-colored transparent display panel 14, that is advantageously styled with an engraved and colored pattern of dots 23, each dot respectively aligned with a corresponding one of the grills 12*a* through 12*f* and thus with a corresponding one of the extended radial portions 21*a* through 21*f* and their respective switch handles S6*a* through S6*f*. Beneath the display panel 14, within the pillar 22, and aligned with the dots 23 is a plurality of lamps (not visible in FIGS. 1 through 3, but shown in FIGS. 4 and 5) that can be individually illuminated by the apparatus circuitry during play to address or "interrogate" the players at the respective stations.

When any of the switch handles S6*a* through S6*f* is depressed, the entire housing 10 tilts or rocks with respect to the base assembly 40, closing a switch S6 (FIGS. 4 and 5) formed at the interface between the housing 10 and the base structure 40 and serving handles S6*a* through S6*f* in common. The switch S6 is here called the "BUZZ switch." Use of the BUZZ switch S6 and the other switches during play is described in detail below.

Mounted to one of the radial sections 21*d* are several other switches (FIG. 1*a*). The POWER switch S1 turns the game apparatus on and off, and allows new players to enter the game under certain circumstances (described below with regard to game 2). The GAME switch S5 selects whether the lamps under display panel 14 will advance sequentially (game 1) or randomly (game 2) in interrogating successive player stations, whether the lamps will interrogate all the stations (game 1) or only those where there are players (game 2), and whether the lamps at stations where an error has been made will continue to be used in the interrogation sequence (game 1) or will be eliminated from further play (game 2). The SPEED switch S3 selects the timing or rhythm of the game interrogation—the choices being "slow," "medium," "fast" or "very fast." The BASE switch S2 selects the base numeral to be used in the game, among choices 3, 5, 7 and 9; this switch is to be set before setting the POWER switch to its ON position. The RESET button S4 is pressed when the players desire to start a new game, i.e., to restart the count from one. The SPEED and GAME switches may be changed at any time during play; however, the BASE switch is only operative to actually change the base number before turning on the power and at the end of a game when restarting with the RESET button.

As explained in the introductory "Background" portion of this specification, the base numeral selected by the BASE switch defines the exact rules of the game: the base numeral establishes what numbers will be "buzz numbers." Any number that contains the base numeral as at least one digit, or that is an integral multiple of the base numeral, is a "buzz number." For example, if the BASE switch is set to 7, the buzz numbers are 7, 14, 17, 21, 27, . . . 63, 67, 70 through 79, 84, 87, etc.

When the GAME switch S5 is set to 1, a relatively simple set of game procedures is used. Play under this set of procedures will be described first. When the POWER switch S1 is set to ON, one of the lamps under the panel 14 lights up and any of the switch handles S6*a* through S6*f* may be pressed to start the game. The lamps under the display panel 14 light up in consecutive sequence, producing a visual effect that rotates around the panel approximately twice, with a simultaneous series of audio signals suggesting (and in fact accompanying) a random search for a starting player position. The sequence stops at one of the stations, and the apparatus emits an interrogating tone (preferably a short "blip" sound) that the players recognize as querying the player at the station where the lamp is illuminated.

The player at that station should speak aloud, in a firm voice, and nominally should say the number "one." (In fact it does not matter to the apparatus what the player says, as long as the player actually says something. It also does not really matter to the apparatus which player speaks, as long as there is an auditory response of sufficient amplitude and duration, near the apparatus.) Assuming that an adequate audible response is made, the next lamp in clockwise direction will illuminate, and the interrogating tone will repeat. Again there must be an adequate audible response from the players to continue play, and in the most straight-forward version of the game the players speak aloud the numbers in the normal counting sequence—the second response being "two," and so on.

When the count reaches a "buzz number," the player who is interrogated by the lighting of his lamp and the sounding of the tone must press one of the BUZZ switch handles S6*a* through S6*f*—nominally, of course, the one that points toward him, but in fact any of the handles has the same effect. When the BUZZ switch S6 is thus actuated the apparatus emits a buzzing tone, and assuming that the player's response is correct a brief tone announces that the player has succeeded in identifying a buzz number. This tone may for example be a "deedle-deedle" sound, but in any event is advantageously distinct from the interrogation tone. After this correct-buzz-response announcement the interrogation cycle continues in tempo.

If the player response to a particular interrogation is wrong—that is, if the BUZZ switch is actuated when the count is not at a buzz number, or if the BUZZ switch is *not* actuated when the count *is* at a buzz number, or if no response is made at all (neither BUZZ switch nor audible response), the apparatus announces an error; the same lamp that was illuminated to interrogate the particular player station now flashes several times, and the apparatus emits an error tone (for example, a loud "raspberry" sound). After the error is announced, the apparatus waits for a signal from the players before continuing the interrogation cycle. When any of the switch handles S6*a* through S6*f* is pressed, that cycle continues in tempo with the next count, all the players remaining in the game and continuing to be interrogated in sequence.

This cycle may be pursued until the count reaches 1000, at which point all the lights flash and the apparatus emits a distinctive end-of-game tone (such as a ringing sound). If the players wish to start again they press the RESET switch S4. To change the base numeral for the next game they set the BASE switch S2 to the desired value before pressing the RESET switch.

When the GAME switch S5 is set to 2, play is similar but with the following three elaborations. First, when the POWER switch is set to ON, the lamp at one of the stations flashes (up to eight times), and the apparatus emits a corresponding inquiry tone. If a player wants to play that position he or she must actuate the BUZZ switch in reply. The lamp at the particular station stays lit momentarily, the apparatus registers that station as "active" in the game, and then the inquiry cycle is repeated for another station. If the BUZZ switch is not actuated in reply to the inquiry within the eight-flash inquiry period, the apparatus registers the corresponding station as inactive for the game, and then the inquiry cycle is repeated for another station. In either event the cycle stops after all of the stations (here six) have been queried. The game then begins without further signal from the players—starting with the random searching effect described above for game 1: the lamps under the display panel 14 light up in a consecutive sequence, producing a visual effect that rotates around the panel approximately twice, with accompanying audio signals, and stops at one of the *active* stations. The game count thus starts at that station, with "one" as in game 1, but only the initially active stations are interrogated.

Second (of the three elaborations mentioned above), the interrogation cycle does not proceed in clockwise sequence as in game 1, but rather in random order so that the players cannot anticipate who will have the next turn.

Third, when there is an error the interrogated station is eliminated from play, so that subsequent interrogations are directed only to the *remaining* active stations. The game can end at count 1000 as in game 1, or when only one active station remains. In the latter case only the lamp at that station flashes, and the end-of-game tone (e.g., bell) becomes in effect a "winner" announcement. If the count has proceeded to 1000 with more than one player still in the game, this signal may be regarded as a "winners" signal. If the players wish to start again they press the RESET switch S4—first setting the BASE switch S2 to the desired value if they wish to change the base number for the new game. When the RESET switch is used in game 2, the apparatus reactivates all the stations *originally replying* to the active-player inquiry cycle. If additional players are to join the game at this point, the POWER switch S1 must be set to OFF and then back to ON to force the apparatus to go through the inquiry cycle anew.

Another switch, the COUNT switch S7, is optionally also provided, for use in lieu of the microphone—for troubleshooting the microphone circuit or playing certain special versions of the game, to be described below.

It will be understood that definite descriptive names are assigned to the switches and other components in this specification and in the appended claims merely for purposes of definiteness of description, and that use of different titles for functionally equivalent elements is not to negative applicability of the appended claims.

II. Construction of the Game Apparatus

The exterior structure of the apparatus has already been introduced. Three of the dots 23 in the display panel 14 advantageously consist of decorative-head mounting screws that can be unscrewed to permit removal of the panel 14 for access to the lamps and wiring within the upper part of the pillar 22. Within the underportion of the horizontal section 21 of housing 10, as shown in FIG. 2, is mounted a circuit board 23 with the switches S1 through S5 and S7 (FIG. 1) and associated interconnections, as well as a microprocessor unit (shown at 13 in FIGS. 4 and 5).

Figure 10:
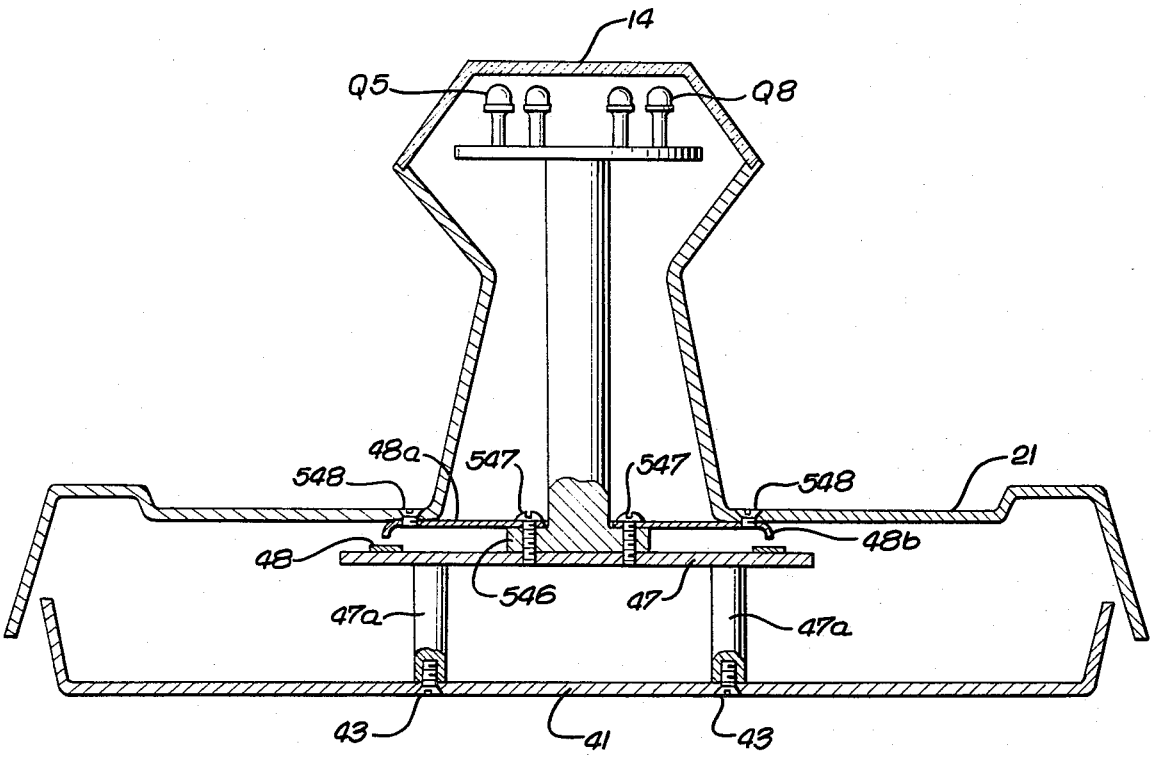
FIG. 10 is a somewhat schematic elevation, mostly in section, showing certain construction details of the FIG. 1 apparatus.

Mounted tiltably or rockably (in any direction) to the underportion of the horizontal section 21 is a disc 47; firmly secured to the upper side of this disc is a metal ring or annulus 48 (FIG. 10), which with a mating metal ring **48*b* firmly secured to the horizontal section 21 forms the contacts of the BUZZ switch S6 (FIG. 2). Firmly secured to the underside of the disc 47 are four pillars 47*a*, which are internally drilled and tapped to receive screws for attachment of the base 40. Thus when the apparatus is assembled the disc 47 becomes stationary, with the base 40, upon the tabletop or other playing surface on which the apparatus is placed, while the upper housing 10** is tiltable or rockable in any direction with respect to the playing surface. In this way the apparatus provided a unitary switch S6 operable in common by pressing any of the switch handles S6*a* through S6*f*.

Wires 45 connect switch S6 and the components on circuit board 23 with audio speaker 15 and batteries 16 mounted within the base 40. Once within the base 40 the umbilical wires 45 separate, appearing as power wires 17 running to the batteries 16, and audio wires 18 running to the speaker 15. The base 40 itself is configured as a flat floor 41, segmented into radial portions **41*a* through 41*f* in correspondence with the radial portions 21*a* through 21*f* of the housing 10, and further configured with upstanding side wall 44 following the entire periphery of the base 40. This side wall 44 extends upward within the downwardly protruding side wall 24 of the housing 10, cooperating with the housing side wall 24 to conceal the various internal components while permitting relative rocking motion of the housing 10 with respect to the base 40. This detail of the structure is best shown in FIG. 3**.

Screw holes 42 defined in the floor 41 of the base 40 facilitate securing the base 40 firmly to the four pillars **47*a* (FIG. 2) by means of mounting screws 43 (FIG. 3), so that the disc 47, carrying one side 48 (FIG. 10) of the BUZZ switch S6 contacts, is firmly secured to the horizontal panel 41 of the base 40 while the other side 48*b* of the BUZZ switch S6 contacts is firmly secured to the horizontal section 21 of the housing 10. A plurality of thin, radial metal strips 48*a* (FIG. 10), advantageously formed integrally with the metallic contact ring 48*b*, provides the tiltable mounting of the horizontal section 21 to the lower panel 41. Screws 548 hold the integral contact ring 48*B* and outer ends of flexible metal mount strips 48*a* to the horizontal section 21. Screws 547 hold the inner ends of the mount strips 48*a* to the disc 47, and thus to the lower panel 41. A spacer 546, advantageously formed integrally with a central support post for LEDs Q5 and Q8 (as well as the four others not identified in FIG. 10) separates the plastic disc 47 from the turned-down metal contact ring 48*b*, while providing mounting for the LEDs. With the panel 41** resting on a tabletop or like surface, depressing any of the switch handles S6*a* through S6*f* flexes the thin, radial metal strips **48*a*, permitting sufficient tilt of the horizontal section 21 to engage contact rings 48*b* and 48—i.e., to close the BUZZ switch. Resilience of the metal strips 48*a*** provides spring-loading that restores the housing to centered upright position, deactuating the BUZZ switch S6, when the handle is released.

Alternatively any conventional "universal" mount arrangement may be used for tiltably or rockably interconnecting the housing 10 and the disc 47, and for spring-loading them as described.

III. Electronics

FIG. 4 illustrates the electronic system in block-diagram form. The BASE switch S2, COUNT switch S7, SPEED switch S3, RESET switch S4, BUZZ switch S6 and GAME switch S5 simply provide input switch connections to a microprocessor unit 13. The microphone 12 receives acoustic signals from the players and forms corresponding electrical signals that are amplified in amplifier A1 and directed to the microprocessor 13 along the same signal line as switch-closure signals from the COUNT switch S7. The microprocessor 13 in response generates output voltages for operating the visual display 14 (more precisely the lamps under the display panel 14) to address particular player stations. The microprocessor 13 also directs relatively high-impedance audio-frequency signals to amplifier A2, which provides corresponding low-impedance signals at the same frequencies to audio speaker 15. POWER switch S1 receives voltage from battery 16 along wire 17 and distributes the power as required to the microprocessor 13 and the amplifiers A1 and A2. The microprocessor 13 is suitably hard-wired or programmed, as will be detailed below, to receive all of the various input information from the microphone and switches and operate the speaker and visual display to bring about all of the various game effects previously described.

Figure 5:
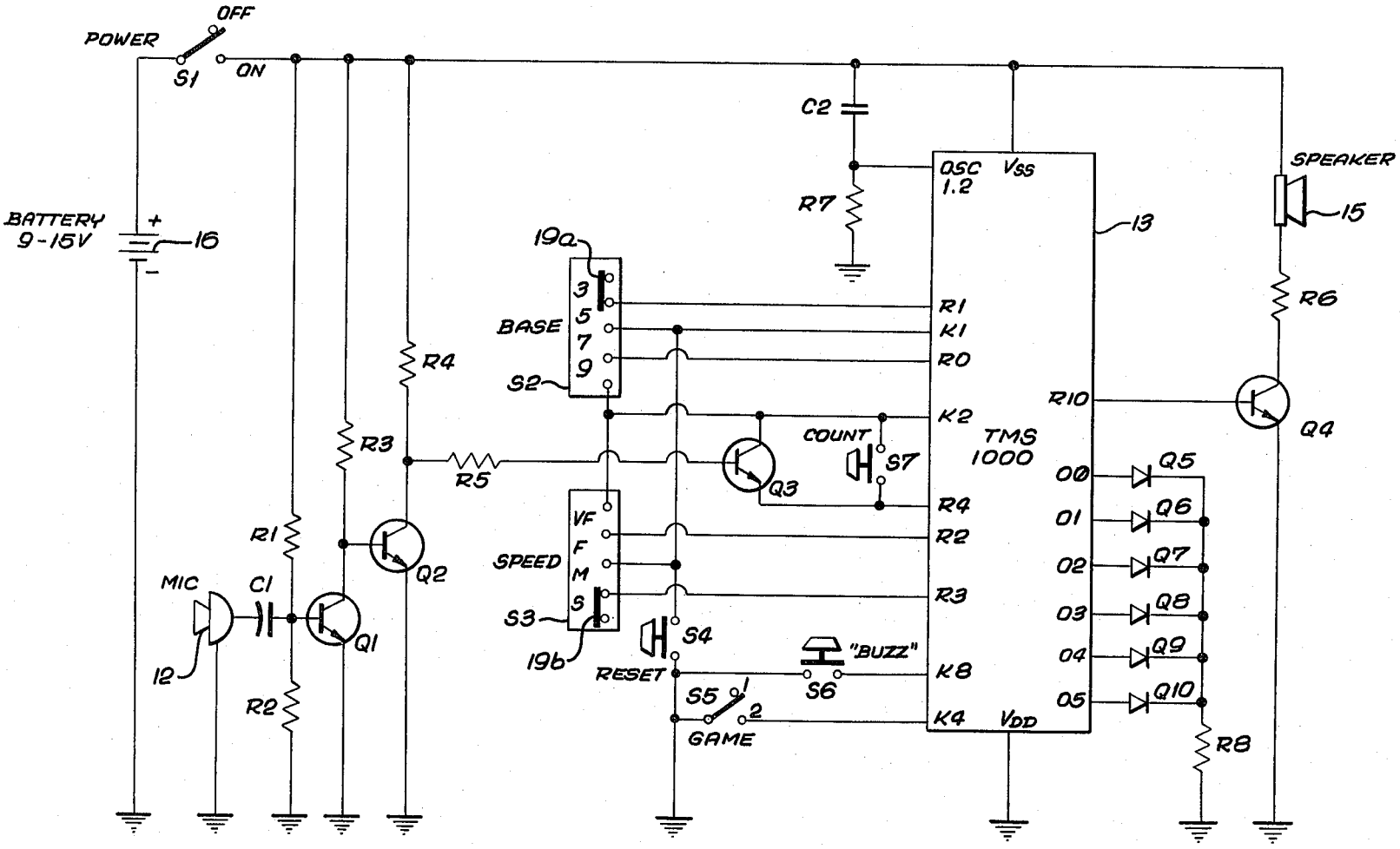
FIG. 5 is a schematic of the same circuit that is block-diagrammed in FIG. 4.

FIG. 5 shows additional circuit details. Battery 16 provides voltage between 9 and 15 volts through single-pole single-throw POWER switch S1, to supply all the components. Amplifier A1 of FIG. 4 is a three-stage amplifier consisting of NPN transistors Q1, Q2 and Q3 in series, the input (base) of the first transistor Q1 being held at constant DC voltage by biasing resistors R1 and R2 but being capacitively coupled at C1 to receive the output signals from microphone 12. Transistors Q1 and Q2 are loaded by collector resistors R3 and R4 respectively. The output of the second-stage transistor Q2 is resistively coupled through R5 to switching transistor Q3, which in effect forms a hard connection between two terminals K2 and R4 of the microprocessor unit 13, when the microphone 12 is acoustically excited. The COUNT switch S7 duplicates this same effect (connects K2 to R4) when the COUNT switch pushbutton is depressed.

The microprocessor 13, advantageously a unit known commercially as a "TMS 1000," receives battery voltage between the "hot" terminal $V_{SS}$ and ground terminal $V_{DD}$, and using this supplied power provides suitable switch-closure sensing voltage at contact R4 for transmission by COUNT switch S7, or by the final switching stage Q3 of the microphone amplifier, to the sensing terminal K2. Similarly the voltage appearing at microprocessor input terminal K2 may be received from a terminal of the BASE switch S2 or a terminal of the SPEED switch S3. When the BASE switch S2 is set to 9, switch-closure sensing voltage is received at K2 via the sliding contact 19*a* from microprocessor terminal R0. Likewise when the SPEED switch is set to VF ("very fast") sensing voltage is received at K2 via the sliding contact 19*b* from microprocessor terminal R2. Appearance of the R4 sensing voltage at terminal K2 thus informs the microprocessor 13 that the COUNT switch S7 or microphone 12 has been activated; appearance of the R0 voltage at that same terminal K2 indicates that the BASE switch S2 has been set to 9, and appearance of the R2 voltage at the same terminal K2 indicates that the SPEED switch S3 has been set to VF.

Of course if all three of the sensing voltages—those from R0, R2 and R4—were *always* available for transmission via the switches S2, S3 and S7 and transistor Q3 to input terminal K2, there could be a problem of distinguishing between the voltages from the three sources. To avoid this ambiguity, voltages are presented at R0, R2 and R4 only at certain specified times during operation of the game, the voltage at input terminal K2 is sampled at correspondingly appropriate times, and the implication that the logic system attaches to the voltages received at those respective times is varied accordingly.

In a similar fashion the microprocessor unit receives switch-closure sensing voltage at its terminal K1, and this voltage is transmitted to terminal K1 from one terminal of either the BASE switch S2, the SPEED switch S3, or the RESET switch S4. When the BASE switch S2 is set to 7 the voltage from R0 appears at K1, and when that switch is set to 5 the voltage from R1 appears at K1. Likewise when the SPEED switch S3 is set to F ("fast") voltage from R2 appears at K1, and when that switch is set to M ("medium") the voltage from R3 appears at K1. Thus appearance of R1 voltage at K1 indicates that the BASE switch S2 is set to 5, appearance of R0 voltage at K1 indicates that the BASE swtich S2 is set to 7; appearance of R3 voltage at K1 indicates that the SPEED switch S3 is set to M, and appearance of R2 voltage at K1 indicates that the SPEED switch S3 is set to F. The appearance of voltage at K1 thus would be ambiguous, as it might be originating at R0, R1, R2 or R3, except for the fact that sensing voltages appear at those four terminals only at specific times during operation and the K1 voltage sampling times and logical interpretations applied are varied correspondingly. When the voltage is sampled at both of the two input terminals K1 and K2 that are connected to the BASE switch S2 terminals, if *neither* of those two terminals is receiving *either* R0 and R1 voltage, then the implication is that the BASE switch is set to 3, since in heat position the sliding contact 19*a* does not pass voltage to either terminal K1 or K2 from any other terminal. Likewise if neither R2 nor R3 voltage appears at either of the two input terminals K1 or K2, at the corresponding voltage-sampling times, then the significance is that the SPEED switch is set to S ("slow" ), since in that position the sliding contact 19 *b* does not pass voltage to either terminal K1 or K2 from any other terminal.

Operation of the RESET switch applies ground voltage from ground connection G to input terminal K1, through RESET switch contacts S4. If this grounding action occurs after a player error, while the game circuit is quiescent, it indicates to the microprocessor 13 that the game is to be restarted with count zero. The GAME switch S5 when set to 2 similarly grounds microprocessor input terminal K4, thus indicating to the microprocessor 13 that game 2 is to be played (and the microprocessor otherwise proceeds with game 1); and BUZZ switch S6 grounds terminal K8 to indicate the various player responses involved in use of that switch.

Output terminal R10 of the microprocessor 13 actuates audio power transistor Q4, which controls power from the battery 16 through the coils of speaker 15, with loading impedance adjusted by resistor R6. The diodes Q5 through Q10 are light-emitting diodes that provide the indicating lamp effects required in the visual display 14 of FIGS. 1 and 4. Voltage to these diodes is provided by the microprocessor 13 via terminals 0ϕ through 05 respectively; suitable limitation of current drawn from the output voltage sources that drive the diodes is inserted at R8.

The microprocessor unit 13 has an internal oscillator for generation of timing pulses, which step the logic system through the program steps described below. The capacitor C2 and resistor R7 connected at terminals "OSC 1, 2" function as the timing components of the oscillator, establishing the pulse frequency (and thus pace of game operations), in accordance with use instructions furnished by the manufacturer of the TMS 1000 microprocessor.

Depending upon the anticipated (or demonstrated) commercial sales volume of the subject game, it is of course within the scope of the instant invention to consolidate transistors Q1, Q2, Q3 and Q4, diodes Q5 through Q10, resistors R1 through R8, and capacitors C1 and C2 into a single integrated-circuit chip—or even to absorb all of those components and the microprocessor 13, with the various interconnections, into a single unitary custom chip.

IV. Operational Sequence

As previously noted the game apparatus must be configured (hard-wired) or otherwise prepared to receive the various switch and microphone inputs and appropriately operate the audio speaker and visual display. In the exemplary preferred embodiment discussed above this is accomplished by a preprogrammed commercial or custom microprocessor unit. In any even the apparatus must follow some predetermined operational sequence. A suitable sequence of operations, forming part of the preferred embodiment of the invention, is described below.

FIG. 6 is a diagram or flow chart of the preferred operational sequence. The input steps—i.e., those performed by the players using the apparatus—are shown in oval blocks numbered from 101 through 107. Certain key intermediate conditions or statuses are shown in oval blocks numbered 201 through 206. The other steps appear in rectangular blocks. The first input step is for the players to select the game, base numeral, and playing speed (step 101), by setting the GAME, BASE and SPEED switches (S5, S2 and S3 respectively, FIGS. 1, 4 and 5). The second input step, at 102, is for the players to set the POWER switch to ON. The apparatus then responds by (step 1) placing certain memory circuits in appropriate conditions, and reading the settings of the GAME and BASE switches. The sequence then diverges depending on the game selection.

In game 1, the apparatus simply sets itself to activate all of the player stations, and then waits for a signal from the players to begin the game; when this signal is supplied, step 103, the apparatus proceeds directly to step 170. In game 2, however, the apparatus canvasses or queries all the player stations in turn, receiving station responses, step 104, from the prospective players; the apparatus sets itself to activate only those player stations from which responses are received, and then proceeds to step 170.

In that step the apparatus randomly selects a starting player station, and as a final preparation for the beginning of the game sets a particular memory bank, which may be referred to as the "count-number register," to zero. The apparatus then proceeds to step 180, a step which is repeated over and over as the game is played. In step 180 the apparatus adds one (the number 1) to the number already into the count-number register, and then performs various calculations to test the number then in the count-number register. One of these calculations is to compare the number in the count-number register with the number 1,000. If the number in the register is equal to 1,000, the procedure branches off to step 189, in which the apparatus prepares to declare the game over. The device simply uses the number 1,000 as an arbitrary value at which to terminate the game. Very few players will care to continue the game this far. If the number in the register is not yet equal to 1,000, the apparatus tests the number for what might be called the "buzz condition." That is, it tests the number to determine whether it either (1) has the base numeral as at least one of its digits or (2) is a multiple of the base numeral. Holding the results of this testing process, the apparatus operates the indicator lamp of the selected player station and sounds the appropriate tone to interrogate the player at that station. The apparatus allows the player a certain time in which to answer—that time being selected by the apparatus in accordance with the setting of the SPEED switch.

The response 105 from the interrogated station normally initiates the next step, at block 190. In some cases there may be no response 105, in which case the expiration of the response time allowed by the apparatus will itself initiate step 190. This step consists of comparing the results of the buzz-condition test with the player's response (or failure to respond). The comparison step 190 may have any one of five possible outcomes, as shown in the logic diagram provided as FIG. 7. In this diagram the possible player responses are listed in column 301: the player may press the BUZZ switch (row 304), or make a sound (row 305) adequate to excite the microphone 12 (FIGS. 4 and 5) and thus turn on transistor Q3 (FIG. 5), or make no active response at all (row 306 of FIG. 7). The terms "buzz flag" and "microphone flag" appearing in FIG. 7 are explained below in connection with FIG. 8*b*. The possible results of the buzz-condition test on the number in the count-number register are tabulated as the headings of columns 302 and 303 in FIG. 7: either the count number satisfies the "buzz conditions" or it does not. FIG. 7 shows that there are two ways in which a player can enter a correct response—press the BUZZ switch when the count number satisfies the buzz conditions (shaded box 206), or make a suitable sound when the count number does not satisfy the buzz conditions (shaded box 201). That is, he or she can press the BUZZ switch when the number is a buzz number (the correct buzz response), or speak into the microphone when the number is not a buzz number (the correct no-buzz response). FIG. 7 also shows that there are three ways in which a player can err—press the BUZZ switch when the count number does not satisfy the buzz conditions (unshaded box 204, the incorrect-misbuzz response), speak into the microphone when the count number *does* satisfy the buzz conditions (unshaded box 202, the incorrect missed-buzz response), and fail to make any response at all (unshaded box 203, the missed-count incorrect response, or actually nonresponse).

Returning to FIG. 6, the same five outcomes are shown as distinct output paths from step 190. The two correct outcomes lead to simpler operational results and will be dealt with first. The correct no-buzz response 201 is not affirmatively recognized by the apparatus—it corresponds simply to correctly counting out a number that is not a buzz number, and doing that is relatively easy, so that apparatus proceeds without ado to selection (step 250) of the next player station to be interrogated. In game 1 the next station is the station immediately clockwise from that just interrogated; in game 2 the next station is selected at random. The game is then continued by following the return path 207, which causes the procedure to return to step 180 (with, of course, the new count number and the new selected player station). But if instead of the correct no-buzz response 201 the outcome of the comparison process in step 190 was the correct buzz response 206, the procedure is just slightly more elaborate: from the correct-buzz response 206 the apparatus goes first to step 210, announcement of the correct response. Since correctly responding with a buzz (pressing the BUZZ switch) is usually somewhat more difficult than merely correctly counting aloud, the apparatus pauses to reward the correct answer by flashing the display lamp at the station responsible for the correct answer, and producing a distinctive "correct" tone, such as a ringing sound. Then, the apparatus proceeds to step 250, return path 207, and step 180 just as in the case of the correct no-buzz response. If there are no errors, the game apparatus proceeds through this relatively simple procedural loop until the count number reaches 1,000, at which time the procedure branches to step 189 and the game ends.

As previously noted, however, there are three ways in which the player can err, and the corresponding three incorrect outcomes 202, 203 and 204 lead to a common "incorrect" path 205. In this path the game apparatus first pauses to announce the error, at step 220, by flashing the display lamp at the station responsible for the error and producing a distinctive "incorrect" tone, such as a rasping buzzer-like sound. In game 1 the apparatus simply then waits (step 260) for the players to signal that they are ready to continue, or perhaps that they would prefer to start a new game instead. In game 2, however, the apparatus proceeds to step 230: it deactivates the station responsible for the error, eliminating the corresponding player from play for the rest of the game, and checks to see whether there are any active stations left. If so, then the game is not yet over and the apparatus as in game 1 proceeds to step 260—a quiescent condition, waiting for the players to signal whether and how they wish to proceed.

If the players signal (input step 106) that they wish to continue the game, the next operation is step 250, the selection of the next player station to be interrogated—just as in the case of the correct answers. After that step the procedure follows the continue-game return path 207 as previously described. From step 260, however, if the players signal (input step 107) that they wish to restart the game from a count of one then the operational sequence proceeds to a different return path, at 208, which causes the apparatus to reset the count-number register to zero and again randomly select the starting player station—step 170, discussed earlier.

If in game 2 at step 230 the apparatus finds that no active stations remain, then the player responsible for the error announced at 220 must have been the last player in the game, and therefore the winner. Accordingly the procedure branches to step 240, the step approached via condition-block 189 from step 180 when the count number reaches 1,000. Regardless of the route by which step 240 is reached, that step consists of flashing the display lamps for all the stations most recently remaining in the game, and sounding a distinctive tone. "All the stations most recently remaining" in the case of game 1 would usually or normally be all (six) stations, and in the case of game 2 could be either one station or (if 1,000 is reached) any combination of the stations, but more specifically those stations that were still active. The distinctive tone may, for example, be a long-sounding bell, or a siren, or some other sound. The apparatus continues these indications while it waits for the players to signal that they want to start another game. If that signal, input step 107, is tendered then all the originally active player stations (normally all six in the case of game 1) are again placed in an activated condition and the apparatus follows the start-game-again return path 208 to step 170. The apparatus will also reread the BASE switch, and if the setting of that switch has been changed since the game was last started from zero it will effectuate the new base-numeral selection. The only other way in which the base numeral can be changed is to turn the power off, set the BASE switch as desired, and then turn the power back on again and start a new game from zero; the reason for this is that a very confusing transition point otherwise occurs in going from one count number with one base numeral to the next count number in sequence with a different base numeral. The other game parameters, however—the game number and the speed—can be changed without restraint during play.

With the apparatus quiescent at either step 260 or 270, or equally at step 120, if the players do not wish to proceed they may simply make no response—or, to save the batteries and silence the siren, they may set the POWER switch to OFF.

Figure 8A:
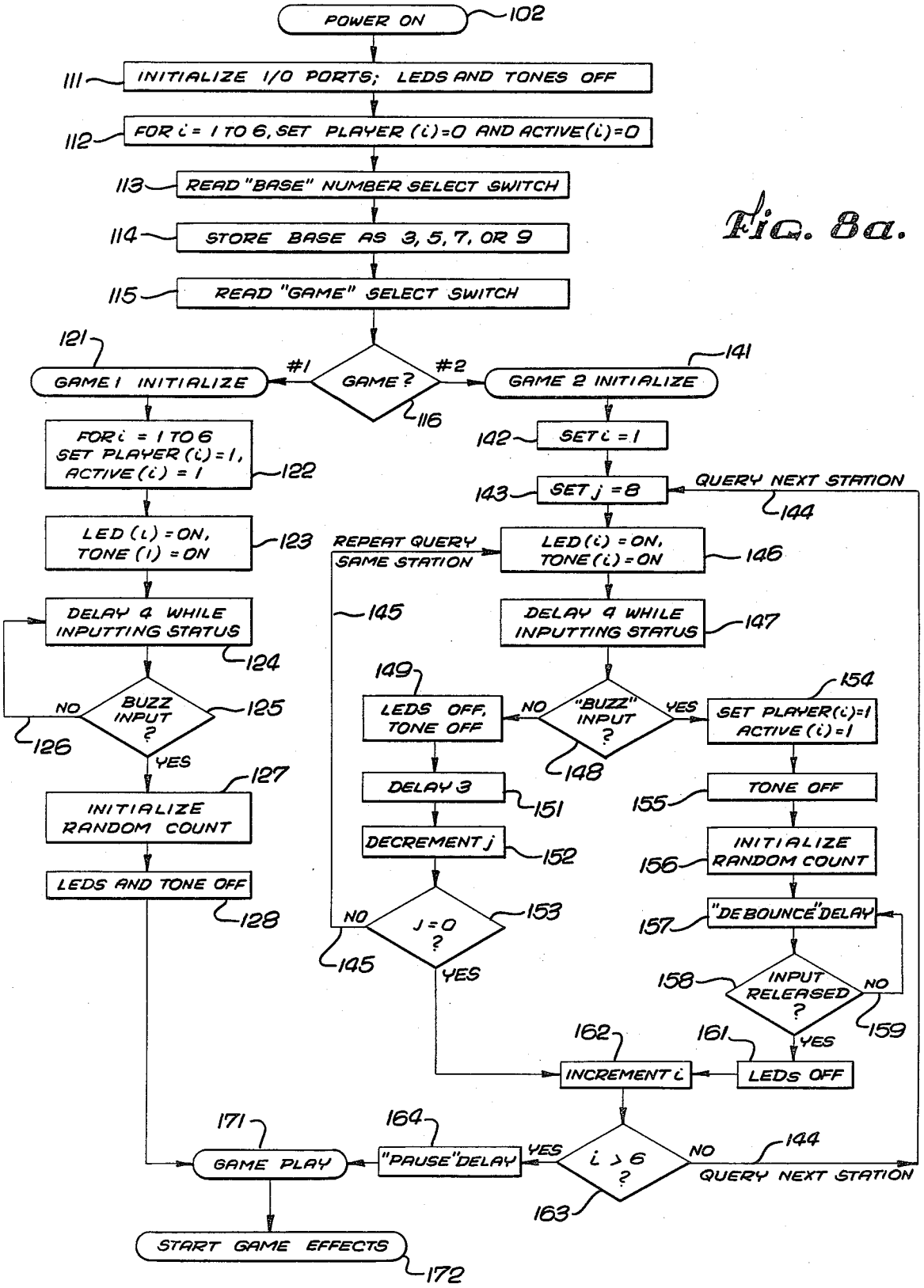
FIGS. 8*a* and 8*b* together make up a more complete flow chart of the same procedure shown simplified in FIG. 6.
Figure 8B:
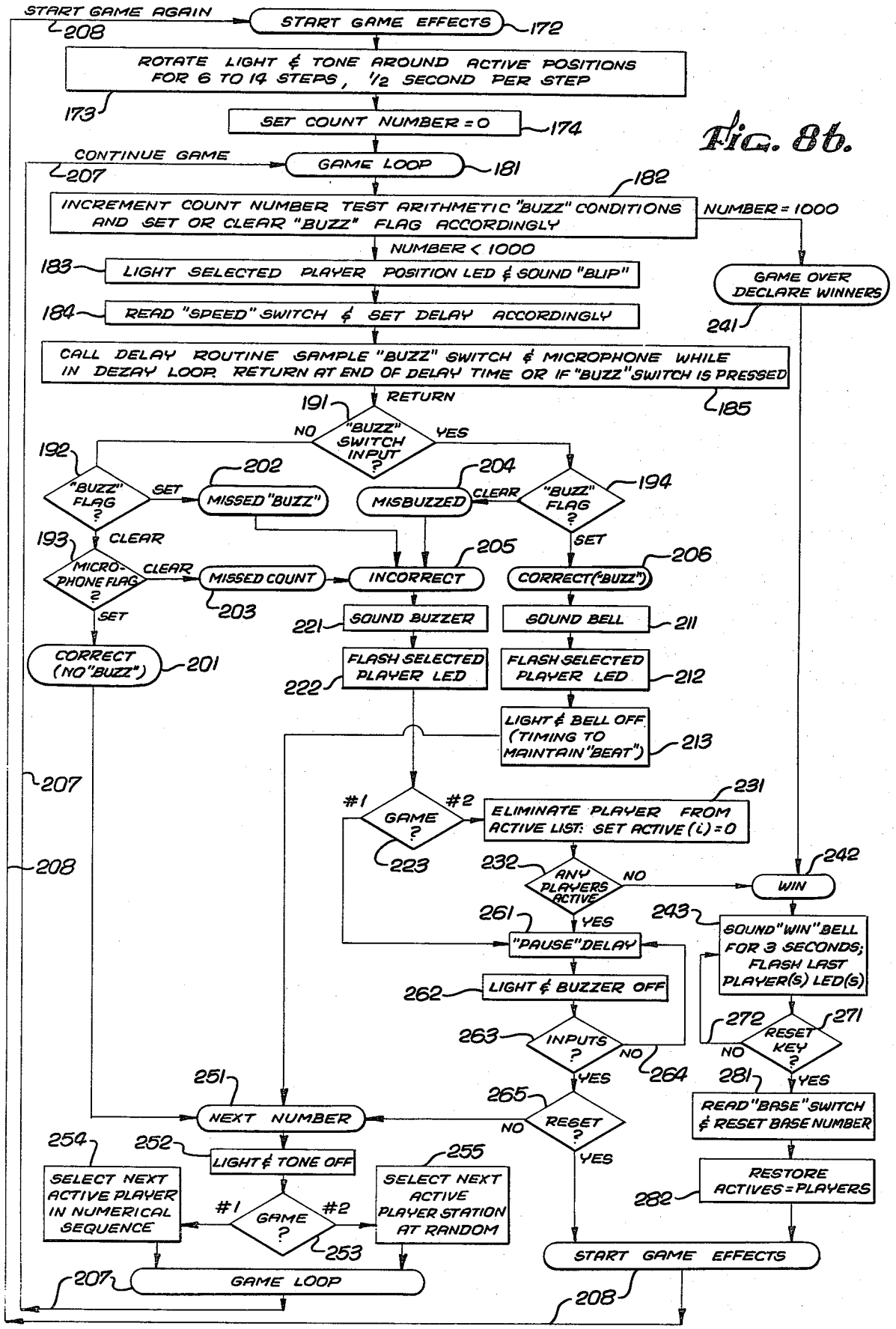

The operational sequence diagrammed in FIG. 6 is shown in greater detail (and slightly different notation) in FIGS. 8*a* and 8*b*. The compound step 110 of FIG. 6 is shown in FIGS. 8*a* to be made up of several steps 111 through 116. In step 111 the apparatus first goes through a power-up procedure in which the audio circuit is positively shut off, and the light-emitting diodes (LEDs) Q5 through Q10 that make up the visual display 14 (FIGS. 4 and 5) are also shut off. These operations may be referred to as "initializing" the output terminals or "ports" of the microprocessor unit 13. At the same time the input "ports" R0 through R4, K4, K8, and K1 in its capacity as an input port (FIG. 5) are also "initialized"—positively brought to the appropriate start-up voltages for correct game operation. As is well-known to persons skilled in the art of programming such devices, failure to provide an orderly power-up or "initializing" process can result in the processor becoming "stuck" or "hung up" in a condition that is meaningless in terms of the game sequence and from which it cannot extricate itself.

The next substep is 112, which can be understood with the help of FIG. 9. That figure includes a tabulation of the memory banks in the microprocessor 13 that are used to keep track of the player stations that are initially in use at the beginning of each game, and the player stations that remain active during play. The letter "i" is used to represent the number of the player station, and thus can assume the values from 1 through 6, as suggested in column 407 of FIG. 9. Column 408 represents a group of memories assigned to recording whether there are players present at the beginning of a game. For example, the memory corresponding to column 408 and row 402 is used to record whether there is a player present at station 2 when a game begins. Column 409 represents a group of memories assigned to recording whether there there is an *active* player present at any time *during* the playing of a game. For example, the memory corresponding to column 409 and row 402 is used to record whether there is an active player at station 2 at a particular time during play. If there is a player at station 2 at the beginning of a game but not at a particular time during play, this would be represented by entry of a "1" (one) in the memory that corresponds to the intersection of row 402 and column 408, and a "0" (zero) in the memory that corresponds to the intersection of row 402 and column 409—and would indicate that the station was active at the beginning of the game but that the player there was eliminated during play. Thus taken as a group the memories represented by the twelve spaces 410 form a matrix giving the initial and instantaneous activity status of the player stations. At step 112 of FIG. 8*a*, as part of the initial power-up sequence, zeroes and stored in all twelve positions of the matrix. Next at step 113 the apparatus reads the BASE switch S2 and at step 114 stores the indicated base-numeral value in a "base-selected" memory 426 (FIG. 9). During subsequent play the apparatus does not again read the BASE switch, but instead refers to the "base-selected" memory 426; this manner of operation implements the desired insensitivity of the apparatus to changes in the BASE switch setting during play, as explained at the end of the discussion of FIG. 6, above. At step 115 the apparatus reads the GAME switch and proceeds to use that reading in branching step 116. (For simplicity the step of reading the GAME switch before similar later branching steps is omitted from FIGS. 8*a* and 8*b*, but it is to be understood that the GAME switch in all such branching steps is read directly rather than being read from a memory; thus the players can change the corresponding game rules during play if they wish.) In step 116, the final substep within step 110 of the simplified FIG. 6 flow chart, the operational-sequence path diverges—being routed to the "game 1 initialize" sequence shown at left if the GAME switch is set to 1, and to the "game 2 initialize" sequence at right if the GAME switch is set to 2.

Step 120 of FIG. 6 is shown in FIG. 8*a* to be made up of several steps 121 through 128. Block 121 actually is only a condition or title block. In step 122 a "1" (one) is stored in each one of the twelve memories corresponding to matrix positions 410 in FIG. 9. That is, for each player-station number from i=1 to i=6, both the player-present and the player-active memories are assigned values of "1." This corresponds to the game-1 rule that all stations are assumed to be in play. At step 123 the apparatus simply announces that it is ready to begin the game by lighting the light-emitting diode (LED) at station number 1 (i=1) and emitting a tone. The unit then becomes quiescent while waiting for the players to signal that they too are ready to begin. The quiescent condition—with the LED lamp and tone both remaining on—is obtained by the combination of steps 124 and 125 and the return path 126, as follows. Step 124 delays for four cycles of the microprocessor timing oscillator (not illustrated), and then tests to see whether the BUZZ switch has been closed by the players. If not, branching step 125 returns operation via path 126 for another four-cycle delay at step 124, and the apparatus remains in this loop indefinitely if the BUZZ switch is not pressed. If that switch is pressed, the sequence proceeds to step 127: in step 127 the apparatus prepares itself for a later step in which it searches at random for a player station at which to start the game. The preparation in step 127 consists of selecting at random a number between 6 and 14, inclusive, and storing that number in a particular memory reserved for the purpose (as suggested at 427 in FIG. 9). The stored value is later used (and will be explained in connection with) step 173. Following step 127 the apparatus turns off the lamp and tone, and proceeds to point 171, the beginning of actual play.

Returning to branching step 116, if the GAME switch was set to 2 the operational sequence reaches the same point 171 through a more elaborate series of steps 141 through 164, which are the detail steps within composite step 140 of FIG. 6. As before the illustrated series begins with a condition or title block 141. The first actual step, diagrammed as "i=1," is to store a "1" in a memory 428, FIG. 9, which is reserved for holding the number of the player station being addressed. Memory 428 may be referred to as the "address-station-'i' memory," or just as "i"—and hence the notation "Set i=1" in FIG. 8*a*. Thus the following sequence of steps is addressed to station 1. At step 143 similarly the value 8 is stored in another memory 429, FIG. 9, that memory being used in counting the number of times a display lamp is flashed. Memory 429 may be referred to as the "flashing-index-'j' memory," or just as "j"—and hence the notation "Set j=8" at step 143. Next the procedure is to turn on the LED display lamp for the station whose number is stored in "i" memory 428, and emit an audio tone—step 146. The lamp and tone remain on while the apparatus waits for four cycles of the microprocessor oscillator, step 147, and the player at station "i" (the station where the LED lamp is illuminated) may respond. If there is no response entered via the BUZZ switch S6 during the four-cycle pause, the branching step 148 passes control to procedural step 149—and the LED lamp and tone are turned off. At step 151 the apparatus waits for three cycles of the oscillator, and then in step 151 the value of "j," the number stored in memory 429 (FIG. 9) is decreased by one. In branching step 153, if the flashing-index value "j" has not yet reached zero the procedure returns by path 145 to step 146, which repeats the query of station "i" (so far, still station number 1). If there continues to be no response from station "i" the light and tone flash again and again as the apparatus goes through the control loop composed of steps 146 through 153 and return path 145, until the flash-index "j" is found at step 153 to have reached zero. The branching step 153 then directs the operation to step 162, where the number stored in memory 428 (FIG. 9) is increased by one, and the new value of that number is tested at step 163 to determine whether it has gone beyond the value 6—corresponding to inquiry of all six player stations. In the example so far the value of "i" is only 2, so the answer to the branching question at step 163 is "no" and the procedure follows return path 144 to step 143. If station 2 also is not tended, so that the eight-flash inquiry elicits no response from that station, the resulting procedure will be identical except that at step 162 the value of "i" will be incremented to 3 before returning to step 143. So far it will be noted that the values stored in all the matrix memories 410 (FIG. 9) are still zero, as they were set in step 112—and the values in the memories at rows 401 and 402 of that matrix will remain at zero throughout the present game. Assuming, however, that there is at least one player in the game, the loop consisting of steps 143 through 162, plus step 163 and return paths 145 and 144, will in due course come to the station(s) that will actually be played. If for example station number 3 is to be played, then at some time during the eight-flash inquiry cycle the player at that station will respond by pressing his BUZZ switch handle. When the branching step 148 is next reached control will then pass to step 154 instead of 149. In step 154 a one will be stored in both of the memories corresponding to row 403 of FIG. 9. Stated more generally, both the player-present and the player-active memories for station "i" are set to one, or in abbreviated form "player(i)=1, active(i)=1." As i=3 in the example, only the third pair of memories is affected. Next the tone is turned off, step 155, and the random-count memory 427 (FIG. 9) is loaded with a randomly selected value between 6 and 14, inclusive, as and for the reasons previously discussed with respect to step 127. Steps 158 and 159 are provided to make certain that the BUZZ switch has been released before the apparatus proceeds to later steps, to avoid confusing the response from station i=3 with the response from station i=4, and so on. In step 157 the apparatus waits while a few microprocessor counts occur and then proceeds to step 158, which tests to determine whether the BUZZ switch has been released yet. If not, return path 159 starts the delay again; if so, the LED lamp for station i=3 is turned off, step 161, and the procedure returns to step 162—previously discussed.

The first three rows of the station-matrix memories in FIG. 9 might now be represented thus:

| i | player present | player active |
|---|---|---|
| 1 | 0 | 0 |
| 2 | 0 | 0 |
| 3 | 1 | 1. |

The apparatus next repeats the loop from steps 143 through 163 three more times, filling in either zeroes or ones in the remaining three rows of the matrix, depending on whether responses to the apparatus-generated "inquiries" are provided by the players. After the sixth pass through the loop, the value of "i" at branching step 163 will be found to exceed 6, and control will pass to block 164. To clearly separate the inquiry or canvass procedure of steps 141 through 163 from the game effects that follow, a "pause" is provided at step 164. The operational sequence then arrives at point 171, the beginning of actual play—and the same point reached through the game-1-initialize steps 121 through 128 discussed earlier. Regardless of which game-initialize sequence is followed, the subsequent operation is controlled in accordance with the steps shown in FIG. 8*b*, which starts with "game play" point 171. This can become significant if the GAME switch setting is changed during subsequent play—specifically, a game that begins as game 2 can be changed to a game-1 kind of game, limited to the stations that are active at the time the GAME switch is reset; or a game that begins as game 1 can be changed to a game-2 kind of game, after the players have "warmed up" with a few rounds of play without penalty of elimination for error.

Turning to FIG. 8*b*, the procedure picks up where FIG. 8*a* leaves off at game-play point 171. The first subsequence, corresponding to composite step 170 of FIG. 6, consists of steps 171 through 174. Steps 171 and 172 are merely reference points in the operational sequence, to which various sequence paths converge as can be seen in the drawings. Step 173 consists of lighting each of the LED lamps in turn, while sounding a synchronized series of tones, to suggest "rotating a light" around the active positions. The number of steps in this series is determined by the randomly selected number loaded into "random-count" memory 427 (FIG. 9) in step 127 or 156. Thus the station at which the searching or "rotating" light stops is in fact randomly selected, through the result is established within the apparatus before the apparent search begins. The station at which the search stops is the selected player station or position for the first count ("one"). At step 174 the count number is initialized to zero, by storing the value zero in a count-number register, 425 in FIG. 9, provided to keep track of the count number. The game is now ready to begin in earnest, as previously shown by reference to steps 180 through 280 of FIG. 6.

Step 180 of FIG. 6 consists of steps 181 through 185 of FIG. 8*b*. "Game-loop" point 181 represents the reference point in the sequence to which the "continue game" return path 207 (FIGS. 6 and 8*b*) is directed. From point 181 the next operation, step 182, is to increment the count number (that is, add one to the value in the count-number register 425), determine whether the new value of the count number is a "buzz number," and set or clear the "buzz flag" accordingly. To determine whether the count has reached a buzz number, of course the apparatus must apply the rules of the game relating to the use of the base numeral (3, 5, 7 or 9—as selected by the BASE switch S2 and stored in the "base-selected" memory 426 at step 114). That is to say, if the base numeral is one of the digits of the count number, or if the count number is an integral multiple of the base numeral, then the count number is a buzz number.

This determination merely involves application of simple arithmetic manipulations that are not central to the invention; in fact, it should be apparent that the criteria for identification of buzz numbers could be partially or completely changed, and suitable implemented in the operational sequence at setp 182, without in the least affecting all the other operation of the game apparatus—provided, of course, that the players too knew of the correct rules. For example, buzz numbers could be defined as all those numbers that do *not* have the base numeral as one digit and are *not* integral multiples of the base numeral. As another example, buzz numbers could be those numbers that have the base numeral as one digit but *not more* than one; or that have the base numeral as one digit *or* are integral mulitples of the base numeral *but not both;* or the buzz numbers could be those numbers containing two digits whose sum or difference equals the base numeral. It is equally within the scope of the invention to prepare and use the apparatus in spelling games played with words, in which certain letters or combinations require buzz responses ("buzz letters"), or games in which certain sentences are recited aloud and particular words in those sentences require buzz responses ("buzz words"). An infinite variety of buzz-condition definitions could be explored, and the task of the game apparatus at step 182 would include the computations or other straightforward processing required to test the count number for the buzz condition as so defined. The precise details of that task are incidental to the practice of the present invention as circumscribed by the appended claims.

Once the apparatus has determined whether the buzz condition is satisfied by the count number, it sets a "buzz flag" accordingly. The buzz flag is a specialized memory unit within the microprocessor, one of two flags in the system, tabulated in column 421 of FIG. 9. Buzz flag 423 simply keeps track of the results of the testing in step 182, for purposes to be described shortly. The buzz flag has two conditions, "set" and "cleared," which of course could equally well be referred to as "1" and "0," "on" or "off," or the like; and the condition established in step 182 is stored in the buzz-flag memory using the convention that the buzz flag is "set" if the number is a buzz number and "cleared" if not. In addition at step 182 the count number is tested to determine whether it has reached 1,000 (in which case control is shifted to point 241, the equivalent of 189 in FIG. 6) or has not (in which case operation continues to step 183).

The first time step 183 is encountered, the apparatus illuminates the LED lamp for the player station selected in step 173. On subsequent passes the apparatus at step 183 lights the LED for the station selected in step 254 or 255, to be discussed later. The apparatus then reads the SPEED switch setting, and sets a corresponding delay duration, at step 184. In step 185 the apparatus "calls" the delay routine—i.e., begins the delay, and continuously samples the BUZZ switch and microphone-controlled transistor Q3 while the delay continues. The apparatus "samples" these two inputs by responding to application of the K2 voltage (FIG. 5) to input terminal R4 of the microprocessor 13, or to grounding of input terminal K8 through BUZZ switch S6. If the microphone-sensing input terminal R4 receives the K2 voltage, the "microphone flag" symbolized at 424 in FIG. 9 is set. The apparatus "returns" from the delay routine when either (1) the BUZZ switch S6 is operated or (2) the delay interval set in step 184 runs out—whichever occurs first. When the apparatus returns it reaches branching step 191, which with steps 192 through 194 makes up composite step 190 of FIG. 6. If there was no BUZZ switch actuation, the sequence passes to step 192 where the condition of buzz flag 423 is tested. If that flag is cleared, then the player's performance has successfully passed the first hurdle: the player did not press the BUZZ switch, and the number was not a buzz number. Branching step 192 therefore directs operation to branching step 193, where the condition of the microphone flag 424 is tested. If that flag is set, then the player's performance has passed the second hurdle: the nuumber was not a buzz number, and the player did speak into the microphone. This leads the apparatus to the "correct no-buzz" condition 201, FIGS. 8*b* and 7, whence it proceeds to the next-number routine 251. Returning to consideration of step 191, if there was a BUZZ switch actuation terminating the delay routine of step 185, then the procedure branches to step 194, also a branching step that tests the condition of the buzz flag 423. If that flag is set, then the player's response must have been correct: the player did press the BUZZ switch and the number was a buzz number. This leads the apparatus to the "correct buzz" condition 206 of FIGS. 8*b* and 7, whence the player is recognized by sounding of a bell-like tone at step 211 and flashing of his LED lamp at step 212. In step 213 the light and bell are turned off, the apparatus pauses to maintain the rhythm of play (since the player may have been very prompt in pressing the BUZZ switch), and control passes to the next-number routine 251 mentioned earlier. This analysis accounts for the two shaded "correct" blocks 201 and 206 of FIG. 7. The "incorrect misbuzzed" condition 204 (FIGS. 8*b* and 7) is reached when the player actuated the BUZZ switch during the delay routine of step 185, directing the apparatus from branching step 191 to branching step 194, but the buzz flag was clear: the player pressed the BUZZ switch but the number was not a buzz number. The "incorrect missed buzz" condition 202 (FIGS. 8*b* and 7) is reached when the player did not press the BUZZ switch, permitting the apparatus to proceed from branching step 191 to branching step 192, but the buzz flag 423 was set: the player did not press the BUZZ switch, but the number was a buzz number. The "incorrect missed count" condition 203 (FIGS. 8*b* and 7) is reached when the player does not press the BUZZ switch during delay step 185, allowing the apparatus to proceed from branching step 191 to branching step 192, and the buzz flag 423 is clear—but the player fails to take advantage of this correct combination: he makes no sound. Thus the microphone flag 424 was not set in step 185, and is still clear at branching step 193, preventing the apparatus from reaching the "correct no-buzz" condition 201. In all these "incorrect" cases—paths 202, 203 and 204—the apparatus is directed to a common "incorrect" operational point 205 (FIGS. 8*b* and 6). In FIG. 6 the next step is composite step 220, which in FIG. 8*b* is seen to consist of steps 221 through 223. At step 221 the apparatus begins to emit a buzzer-like tone announcing the player's error; at step 222 the player's LED lamp begins to flash; and at step 223 the procedure diverges depending on the setting of the GAME switch S5 (FIGS. 1, 4 and 5).

In game 1, as shown in FIG. 6, the apparatus proceeds to composite step 260, which FIG. 8*b* shows consists of steps 261 through 265. Step 261 is a delay sequence, at step 262 the light and buzzer are turned off, and at branching step 263 the apparatus waits for input response from the players—either a BUZZ switch actuation, indicating that the players want the game to continue, or a RESET switch S4 actuation, indicating that the players want the game to start again from one. If neither of these inputs has been received when the step-261 delay runs out, then return path 264 reinitiates the delay and the apparatus remains quiescent, waiting for instructions. If one of the inputs is received in time, then the branching step 263 directs control to another branching step 265, which tests the RESET switch S4. If it is not closed then the input must have been caused by the BUZZ switch, and operation proceeds to the next-number sequence 251. If the RESET switch is closed, however, then from branch step 265 operation proceeds to the start-game-effects point 208, which is a return path to starting point 172 shown at the top of FIG. 8*b*.

From composite block 220 (FIG. 6) or branching step 223 (FIG. 8*b*) it is alternatively possible—if game 2 is being played—to proceed to composite step 230 of FIG. 6, previously discussed. In FIG. 8*b* that composite step is seen to consist of steps 231 and 232: the erring player is eliminated (step 231) from the active list by setting the appropriate memory in column 409 of FIG. 9 to zero, and the apparatus then tests (step 232) to determine whether any stations remain active. This test is conducted by checking each of the six memories in column 409 of FIG. 9. If any contains a "1" (one), there is still at least one active player, and control proceeds to step 261 as in game 1. If not, control passes to the "win" sequence 242.

As has been shown, the apparatus can reach the next-number sequence 251 by any of three different paths. Sequence 251 is the beginning of the composite step 250 in FIG. 6; that composite step continues with step 252 through 255 of FIG. 8*b*. In step 252 the LED lamp and tone are shut off in case they were left on at step 183 and not yet turned off (as can happen in the "correct no-buzz" sequence), and then the procedure diverges depending upon the game being played. If the GAME switch is set to 1, the branching step 253 causes the apparatus to select the next active player is numerical sequence, step 254, which is accomplished by, in effect, advancing along column 409 (FIG. 7) in a consistent direction, stopping at each nonzero value stored in the corresponding memories. Since the GAME switch may previously have been set to 2 during the same game, it does not necessarily follow that this procedure will result in interrogating all of the stations. Operation of step 231 may have deactivated one or more stations, setting the corresponding memories to zero, before the GAME switch was set to 1. If branching step 253 directs the sequence to step 255, because the GAME switch is set to 2, the apparatus selects the next active player station at random. Symbolically speaking, this is accomplished by searching column 409 of FIG. 7 for a nonzero value—but doing so in random order. Since the GAME switch previously may have been set to 1 during the same game, if does not necessarily follow that this procedure will result in interrogating only players who have not previously made errors during the game. Operation of branching step 223 previously may have insulated the erring player from elimination, before the GAME switch was set to 2. From either step 254 or step 255 the apparatus returns to the beginning of the main "game loop" along return path 207.

The foregoing passage, and certain other portions of this specification, describe what may be called "game hybrids" that result from changing the setting of the GAME switch during play. The response of the game apparatus to such changes depends upon an assumption, mentioned earlier in connection with program step 115 (FIG. 6), that the GAME switch is read directly at each branching step 116, 223, 253, rather than being read from a memory. It will be recalled that the latter technique is used in connection with the BASE switch S2, whose setting is stored at step 114 in the "base-selected" memory 426 (FIG. 9). Another assumption is implicit in all of the discussions of game hybrids—namely, that the flow-charts of FIGS. 8*a* and 8*b* are implemented exactly by the final production programming, so that there are no "holes" in the software that prevent sequencing of the apparatus smoothly if the GAME switch setting is changed during operation. It is to be understood that it is within the scope of the invention to program the microprocessor in such a way that these assumptions are not true; in such a case the GAME switch setting might, for example, be stored at step 115 (FIG. 6) in a "game-selected" memory analogous to the "base-selected" memory 426. In this variant apparatus changes of the GAME switch setting would become effective only after the power was turned off and then back on, to gain access to step 115. In any event, the game rules as printed for players to learn and follow need not allow GAME-switch changing during play even if the equipment does.

As shown in FIG. 6 there are two ways in which the game can be ended by the game apparatus, apart from the players' option to end the game at step 260. These two ways are by reaching the "game over" condition 189 and by eliminating the last active station at step 230: either of these two happenings leads to step 240 of FIG. 6. That step is the same as step 243 of FIG. 8*b*, which indicates that the apparatus sounds a distinctive bell-like tone for a specified interval, and flashes the LED lamp(s) of the last active player(s). The "waiting" step 270 of FIG. 6 consists of branching step 271 in FIG. 8*b*, which simply returns control to the bell-sounding step 243 if the RESET switch S4 has not been pressed. Thus the bell continues to sound and the lamp(s) to flash until the RESET switch is actuated or the POWER switch set to OFF. If the RESET switch is pressed, the apparatus at step 281 again reads the BASE switch S2, and stores the selected value in memory 426 (FIG. 9). Then the apparatus at step 282 stores a "one" (one) in each memory of column 409 that is adjacent to a "1" in the adjacent memory in column 408. Thus the player stations that responded when the game was first begun (step 140 of FIG. 6), or in the case of game 1 all the stations, are returned to active participation in the game. The procedure then returns to the beginning of the game via the "start-game-effects" return path 208.

The foregoing disclosure is intended to be merely exemplary, and not to limit the scope of the invention—which is to be determined by reference of the appended claims.

I claim:

1. An electronic game apparatus comprising:

electronic means for generating player-interrogation signals;

electronic means for defining a "correct" sequence of auditory and switch-closure player responses to the player-interrogation signals in accordance with game rules;

electronic means for receiving auditory player response to the player-interrogation signals, an electronic means for receiving switch-closure player responses to the player-interrogation signals, and electronic means for comparing the auditory and switch-closure player responses with the "correct" responses; and means, responsive to the comparing means, for indicating whether each response is correct.

2. The apparatus of claim 1 comprising:

a unitary housing that supports and encloses the signal-generating, sequence-defining, response-receiving, comparing and indicating means, and that defines and forms a plurality of player stations; and visual display means associated with each station, and responsive to the interrogation-signal-generating means, for interrogating a player at that station.

3. The apparatus of claim 1 comprising:

a BASE selector switch functionally interconnected with the sequence-defining means for use in defining the "correct" sequence;

a SPEED selector switch functionally interconnected with the interrogation-signal-generating means to select the frequency of presentation of interrogation signals;

a BUZZ switch accessible to a player at each station, and functionally interconnected with the switch-closure response-receiving means, for player use in making switch-closure responses to the player-interrogation signals; and a microphone responsive to a player at each station, and functioning as part of the auditory response-receiving means, for player use in making auditory responses to the player-interrogation signals.

4. The apparatus of claim 3, wherein:

a single unitary BUZZ switch serves all the stations, and a single unitary microphone serves all the stations.

5. The apparatus of claim 3, also comprising:

a RESET switch, functionally interconnected with the sequence-defining means, for initializing the sequence of "correct" responses.

6. The apparatus of claim 5, also comprising a GAME switch functionally interconnected with the interrogation-signal-generating means for selecting the manner in which player-interrogation signals are sequenced and the extent to which subsequent player-interrogation signals are modified in reaction to any "incorrect" response.

7. The apparatus of claim 6, also comprising:

a COUNT switch, functionally interconnected with the interrogation-signal-generating means, for player use in making nominally auditory responses to the player-interrogation signals without actually exciting the microphone.

8. The apparatus of claim 6 wherein the GAME switch selects either:

an interrogation signal sequence in which all player stations are interrogated in the order of their relative positions, and the subsequent player-interrogation signals are not modified at all after an "incorrect" response; or an interrogation-signal sequence in which only those stations are interrogated that are in use by a player, and they are interrogated in an apparently random order, and after an "incorrect" response is made to interrogation of a particular station the subsequent interrogation signals are modified to the extent that that station is bypassed for the duration of the game.

9. An electronic competitive response game apparatus being preprogrammed in accordance with game rules and for use by at least one human player, the apparatus comprising:

a unitary housing defining a plurality of player stations, each station having associated with it a respective player-interrogation light, a respective microphone grill, and a respective switch handle adapted to be manipulated by switch-closure motions by such human player;

a single microphone mounted within the housing and responsive to sounds made at any of the plural player stations to generate electrical signals corresponding to such sounds;

a first electronic amplifier within the housing and connected to receive the electrical signals from the microphone and generate corresponding amplified signals at the amplifier output;

a unitary game-response switch defined within the housing and responsive to switch-closure motions made at any of the plural switch handles;

an audio speaker mounted to the housing, and a second electronic amplifier within the housing functionally connected to amplify electrical audio-frequency signals and direct them to energize the speaker;

electronic means, functionally connected to the lights, the switch, the first amplifier output and the second amplifier input, for:

operating the lights and energizing the speaker to interrogate the player stations in an interrogation sequence, receiving responses entered from the player stations by means of the microphone and first amplifier and the game-response switch, defining a "correct" sequence of microphone and switch responses in accordance with such game rules, and determining and indicating, by operating the lights and energizing the speaker, whether the response sequence actually received is "correct";

a first selector switch, connected to actuate the electronic means, for controlling the rapidity with which the electronic means progress through the interrogation sequence;

a second selector switch, connected to actuate the electronic means, for choosing the game rules by which the electronic means define the "correct" response sequence;

a third selector switch, connected to actuate the electronic means, to choose which lights the electronic means operate, the order in which the electronic means operate the lights in the interrogation sequence, and whether modifications are made to the interrogation sequence after an "incorrect" response; and a pushbutton switch, connected to actuate the electronic means, for initializing the "correct" response sequence.

* * * * *